US009079230B2

(12) United States Patent
Cernuschi et al.

(10) Patent No.: US 9,079,230 B2
(45) Date of Patent: Jul. 14, 2015

(54) ROLLING STAND WITH THREE WORKING ROLLS

(71) Applicant: DANIELI & C. OFFICINE MECCANICHE S.P.A., Buttrio (IT)

(72) Inventors: Ettore Cernuschi, Castelletto Sopra Ticino (IT); Aristide Giacomo Bertelli, Bresso (IT); Danilo Galletti, Milan (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 122 days.

(21) Appl. No.: 14/048,822

(22) Filed: Oct. 8, 2013

(65) Prior Publication Data

US 2014/0096580 A1 Apr. 10, 2014

(30) Foreign Application Priority Data

Oct. 10, 2012 (IT) ..... MI2012A1708

(51) Int. Cl.
*B21B 31/08* (2006.01)
*B21B 17/02* (2006.01)

(52) U.S. Cl.
CPC ..... *B21B 17/02* (2013.01); *B21B 31/08* (2013.01)

(58) Field of Classification Search
CPC ..... B21B 13/005; B21B 13/12; B21B 17/02; B21B 31/02; B21B 31/08; B21B 31/10; B21B 31/16; B21B 31/22; B21B 31/24; B21B 31/28
See application file for complete search history.

(56) References Cited

U.S. PATENT DOCUMENTS

| | | | | |
|---|---|---|---|---|
| 6,041,635 | A * | 3/2000 | Cattaneo et al. | 72/235 |
| 6,945,084 | B2 * | 9/2005 | Bindernagel et al. | 72/224 |
| 2011/0277527 | A1 * | 11/2011 | Cernuschi et al. | 72/239 |

FOREIGN PATENT DOCUMENTS

| | | |
|---|---|---|
| JP | 08103816 | 4/1996 |
| WO | WO9719767 | 6/1997 |

* cited by examiner

*Primary Examiner* — Teresa M Ekiert
(74) *Attorney, Agent, or Firm* — Stetina Brunda Garred & Brucker

(57) ABSTRACT

A rolling stand (1) with three working rolls (5, 6, 7) defining a rolling axis (X) and comprising a roll-holding cartridge (2) in which said three working rolls (5, 6, 7) with respective chocks are accommodated; wherein a locking device (20) is provided for locking the position of the chocks within the roll-holding cartridge (2), in order to lock the chocks in a predetermined position before carrying out a lateral extraction of the roll-holding cartridge (2) from the rolling stand; wherein said locking device (20) is of the movable type and controlled by control means.

9 Claims, 4 Drawing Sheets

ROLLING STAND WITH THREE WORKING ROLLS

FIELD OF THE INVENTION

The present invention relates to a rolling stand with three working rolls used in rolling mills for the production of tubular seamless bodies or for rod-shaped bodies in general.

BACKGROUND ART

Several types of rolling stands with three working rolls are known for rolling tubular seamless bodies with mandrel or for rolling rod-shaped bodies in general. Said working rolls are fixed inside a roll-holding cartridge that allows the concurrent extraction of the three rolls from the rolling mill, transversally to the rolling axis, both in the case of a change of rolls for normal maintenance, and in the case of stuck when the tube itself, sometimes with the mandrel therein, must be removed from the rolling mill.

A known rolling stand includes, for each working roll:

- a hydraulic capsule for adjusting the radial position of the working roll with respect to the rolling axis of the rolling mill;
- a spindle, such as a toothed or Cardan spindle, for transmitting the rotation motion to the roll;
- a motor and a gearbox, arranged upstream of the spindle and connected thereto.

Before removing the roll-holding cartridge from the rolling stand it is necessary to disconnect the hydraulic capsules and the spindles from their respective working rolls.

In order to both carry the roll-holding cartridge, by moving the cartridge by means of an overhead crane, and rotate the cartridge by means of a cartridges-turning machine within the roll workshop, it is currently necessary to keep the rolls fixed with respect to the cartridge to prevent a displacement thereof during the transfer to another location. The fixing of the rolls in the cartridge in transport position, for example, is done by manually inserting some stops, suitable for blocking the roll chocks within the cartridge. These stops, such as pins that are engaged with interferences to the chocks, prevent the risk of sudden movements or downfalls of the chocks during the movement of the cartridge.

However, the fact of having to assemble, and then manually remove these stops is a long and complex operation that requires the use of many workers, in any case subjected to a dangerous activity, considering the weight and the dimensions of the mechanical parts to be managed, and the temperatures at which parts of the stands are.

The need of providing a rolling stand that allows the above drawbacks to be overcome is therefore felt.

SUMMARY OF THE INVENTION

The primary object of the present invention is to implement a rolling stand with three working rolls provided with a locking device for locking the roll chocks within the roll-holding cartridge, in order to lock the chocks in a predetermined position before the lateral extraction of the cartridge from the rolling mill, which is more efficient and safer.

A further object of the invention is to implement a rolling stand for tubes wherein the working rolls can be replaced more easily, quickly and safely.

These and other objects are achieved by a rolling stand with three working rolls for rolling seamless tubes with mandrel, the rolling stand defining a rolling axis and comprising a bearing structure; three working rolls each having a respective median plane lying on the rolling axis, wherein the median planes form an angle of 120° with each other, each of said three working rolls having a respective chock; a roll-holding cartridge in which said three working rolls and said chock are accommodated; a locking device for locking the position of said chocks within the roll-holding cartridge, in order to lock the chocks in a respective first radial position which allows an extraction of the roll-holding cartridge from the bearing structure and an insertion of the roll-holding cartridge in the bearing structure in a direction transversal to the rolling axis; wherein said locking device comprises three stopping pins, fastened to the roll-holding cartridge, and control means connected to the three stopping pins by means of a kinematic mechanism which allows a combined actuation of the three stopping pins so that each of the three stopping pins locks a respective chock in said respective first position.

It is particularly advantageous to provide for the control means of the locking device to include a single actuator, fixed to the bearing structure and connected, by means of a quick coupling and release device, to a single kinematic mechanism, the latter almost entirely mounted on the cartridge and capable of transmitting the locking movement of the chocks to the three stopping pins in the radial position, with respect to the rolling axis. This reduces the time required by the cartridge to exit from the fixed bearing structure of the rolling stand. In fact, the operation for connecting the actuator to the stopping pins is just a simple operation of quick coupling and quick release of two shape elements which takes place almost simultaneously to the extraction or insertion of the cartridge inside the bearing structure.

The technical solution proposed by the present invention further allows the implementation of a more cost-effective rolling stand, reducing the weight and the complexity of the whole rolling mill, thanks to the possibility of using traditional hydraulic capsules that have a shorter working stroke, thereby avoiding the use of hydraulic dual-stroke capsules with hollow piston to reduce the maximum stroke of the capsules.

It is a considerable advantage to carry out the rolling of seamless tubes with mandrel on rolling mills with three rolls per stand using hydraulic capsules for adjusting the radial position of the rolls having a limited working stroke, e.g. in the order of 100-150 mm. In fact, the rolling being necessarily discontinuous due to the presence of an internal tool that must be inserted and removed from each rolled tube, when the head end of the tube passes under each stand the pressure inside the main chamber of the hydraulic capsule undergoes a sudden increase, and due to the elastic compressibility of the oil itself, the capsule piston moves backwards normally by a few tenths of millimeter, thus generating an undesired thickening on the wall in the head area of the tube. Such a phenomenon worsens stand after stand and, in addition, it should be noted that due to the increased irradiation in the head area with respect to the body, the tube ends are always colder and therefore more resistant to deformation. For this reason, the capsule must advantageously have a limited stroke that requires a smaller volume of oil, in order to guarantee the suitability of the control dynamics thereof.

The mechanical adjustment needs of the hydraulic capsules, rigidly mounted on the fixed frame of the rolling stand, are as follows:

- always keeping a few mm of oil into the annular chamber,
- having a range of adjustment in closing on a predetermined mandrel to roll a tube in conditions of reduced thickness compared to the nominal one, compensating the reduction of diameter of the roll as a result of the returning needed to restore the worn surface of the roll itself, ensuring an emergency stroke in the event of tube stuck in the rolling mill to remove the stuck tube and possibly the mandrel.

Furthermore, in the prior art, in order to allow the lateral extraction of the cartridge from the rolling mill, a further stroke is provided to place the piston of the lower inclined hydraulic capsule out of interference of the relevant group formed by roll, chocks and yoke support that joins the chocks themselves.

The sum of these strokes for rolling mills for average range of tubes, e.g. for tubes up to a nominal diameter of 10¾", would not be compatible with the proper functioning of the hydraulic capsules themselves.

However, in the case of lateral change, it should be noted that in order to extract the cartridge from the rolling mill as a result of a stuck, the tube itself and the mandrel therein must be removed from the rolling mill, and consequently it is not necessary to add the "out of interference" stroke for extracting the cartridge in normal operating conditions to the emergency stroke, since the need for the two strokes is never simultaneous.

Therefore, after performing the emergency stroke and removing the stuck tube, cutting it into pieces, and the mandrel, it is necessary to return the working rolls to a position of containment within the space occupied by the cartridge that does not leave any parts protruding out of such a space and constrain them to such an innermost position to proceed with the lateral extraction of the cartridge from the rolling mill.

Locking the chocks of the working rolls using the locking device of the rolling stand according to the invention, in the containment position within the cartridge, other than the typical natural position taken with the sliding of the roll-chock groups due to their own weights, favors the movement necessary to bring the lower inclined capsule piston out of interference and allows an easier extraction of the cartridge. In fact, in the prior art, when the roll-chock groups are released from the respective hydraulic capsule, the upper inclined roll-chock group rests on fixed stops in the innermost position that it can occupy in the cartridge, the lower inclined roll-chock group rests on fixed stops in the outermost position that it can occupy with respect to the cartridge, and the horizontal roll-chock group is brought to the fully open position to avoid interference with the upper inclined group, i.e. to avoid the contact of its roll with the roll of the upper inclined group. This configuration, stable from the point of view of gravity, is clearly not favorable for the lateral extraction of the cartridge, thus a system must be provided to bring lower inclined capsule piston out of interference and allow the extraction of the cartridge.

The dependent claims refer to preferred and advantageous embodiments of the invention.

BRIEF DESCRIPTION OF THE DRAWINGS

Further features and advantages of the invention will appear more clearly from a detailed description of preferred but non-exclusive embodiments of a rolling stand with three working rolls, according to the invention, described by way of a non-limiting example with the help of the accompanying drawing tables, in which.

Same reference numerals in the various figures correspond to same elements or components.

DETAILED DESCRIPTION OF PREFERRED EMBODIMENTS OF THE INVENTION

Figure 1:
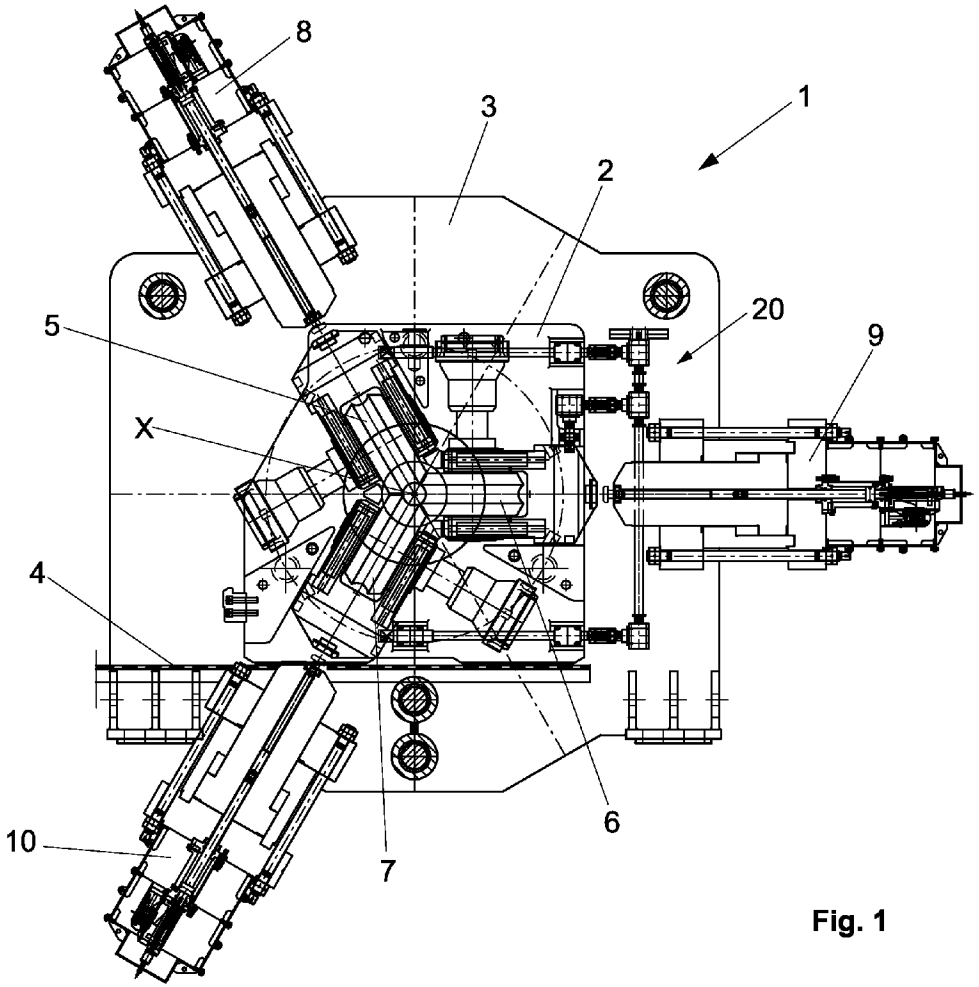
FIG. 1 shows a diagrammatic view of a rolling stand according to the invention.
Figure 2:
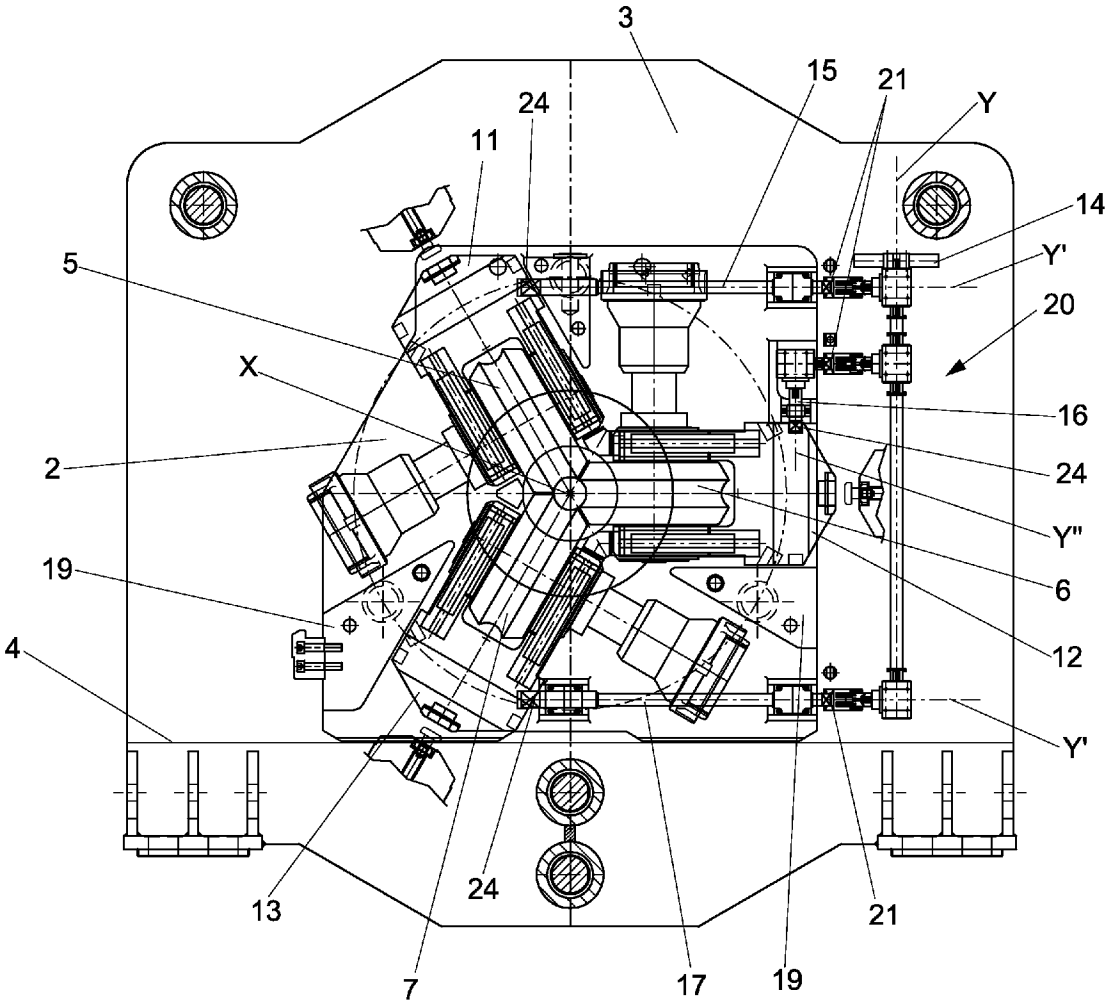
FIG. 2 shows an enlargement of a part of the rolling stand in FIG. 1.
Figure 3:
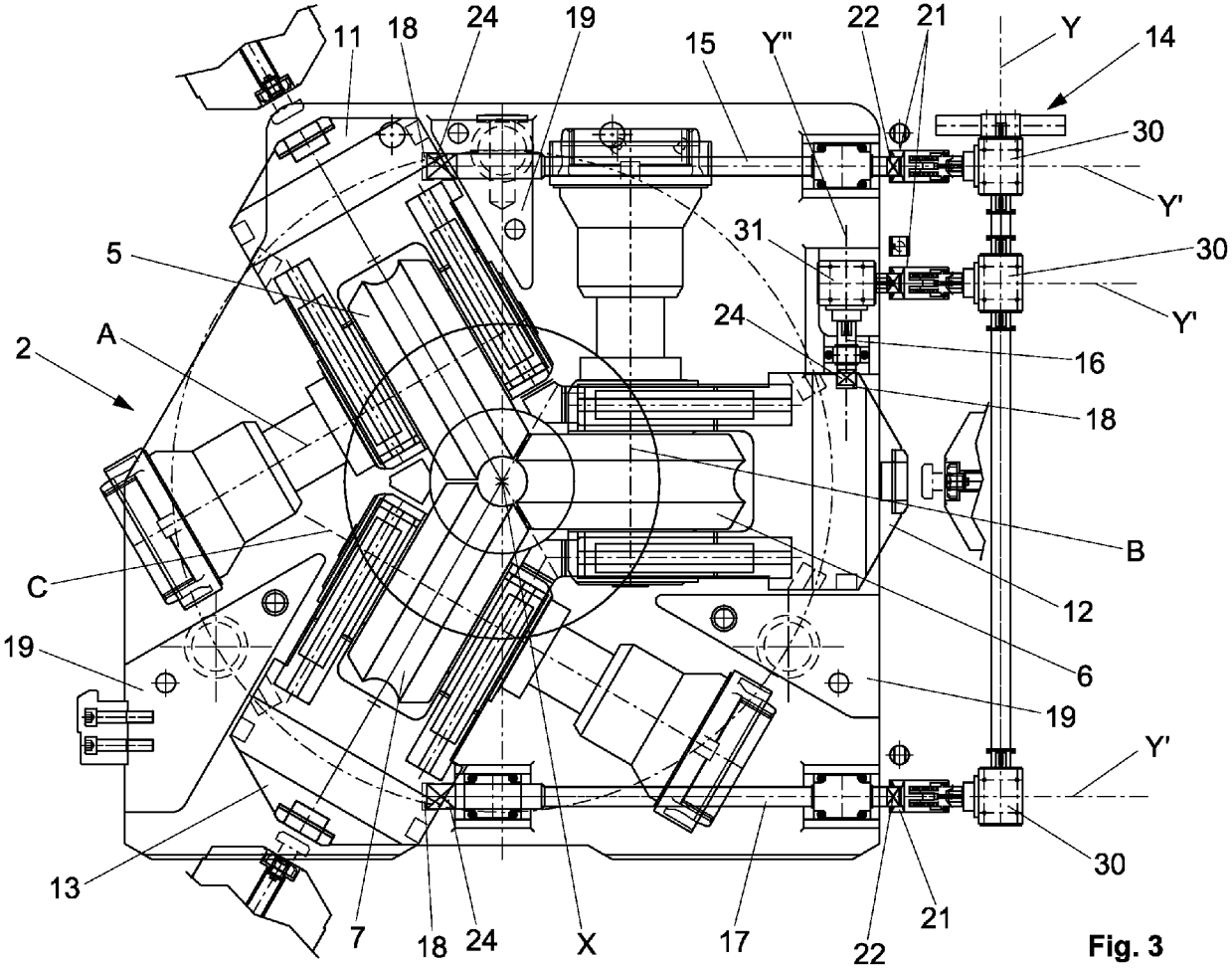
FIG. 3 shows an enlargement of the part of the rolling stand in FIG. 2.
Figure 5:
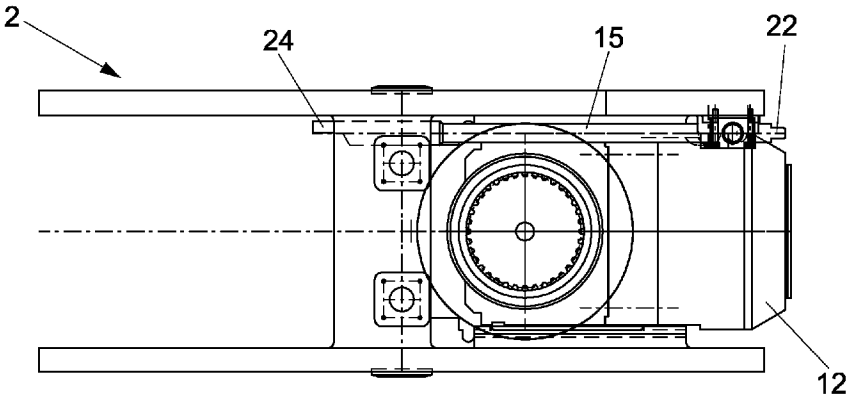
FIG. 5 shows a partial top view of the part of stand in FIG. 3.

With particular reference to FIGS. 1 to 3, the assembly of a rolling stand is shown, globally indicated with reference numeral 1, which includes a fixed bearing structure 3, provided with a pair of rails 4, and a roll-holding cartridge 2, or simply cartridge, configured for running on said rails 4.

Three working rolls 5, 6, 7 are arranged inside cartridge 2 which can be extracted from the rolling mill, transversally with respect to the rolling axis X, both in the case of a change of rolls for normal maintenance, and in case of stuck, where the tube itself and possibly the mandrel therein must be removed from the rolling mill. Each working roll 5, 6, 7 has a rotation axis thereof orthogonal to the rolling axis X and a median plane thereof that lies along the rolling axis X.

The following is provided for each working roll 5, 6, 7, respectively:

a hydraulic capsule 8, 9, 10 for adjusting the radial position of the working roll with respect to the rolling axis X of the rolling mill;

a working roll balancing system, coaxial to said hydraulic capsule, for balancing the weight thereof and maintaining the position thereof between the rolling of one tube and another one;

a yoke support 11, 12, 13, on which the working roll with the relative chocks is mounted, provided with an engagement groove for the balancing system;

a spindle (not shown), such as a toothed or Cardan spindle, for transmitting the rotation motion to the working roll;

a motor and a gearbox (not shown) provided upstream of and connected to said spindle.

The rotation axes A, B, C of the three working rolls 5, 6, 7 are arranged at 60° with respect to one another or, if preferred, the median planes of the working rolls orthogonal to the respective rotation axes A, B, C are arranged at an angular distance of 120° from one another with respect to the rolling axis X. Such an orientation is offset by 60° with that of the working rolls of the adjacent stand in the rolling mill.

A spindle (not shown) is arranged vertically, above cartridge 2, and two spindles are inclined with respect to the vertical axis by a predetermined angle, equal to about 60°, so as to prevent the cooling water drain from creating problems of corrosion and damage to the spindles and the gearboxes.

Advantageously, all the hydraulic capsules in the rolling stand of the invention are simple stroke. The hydraulic capsules 8 and 10 are suitably inclined with respect to the vertical axis by an angle of +/−30°, and configured to provide such an opening of the piston to allow the extraction of the roll-holding cartridge 2 horizontally, on the side opposite to the hydraulic capsule 9 arranged horizontally.

The yoke supports 11, 12, 13 are radially sliding with respect to the rolling axis X. To this end, guides are provided in cartridge 2, within the working roll seats, which guides allow the movements of the yoke supports to be guided, which supports can be radially extracted from the cartridge, once extracted from the rolling stand. In fact, cartridge 2 is open at said guides to allow the radial movement of the yoke supports with the rolls, without necessarily having to disassemble the cartridge. Cartridge 2 is also provided with blocks 19 for stiffening its own structure, which can be formed, for example, of two half-shells connected together along a median junction line.

Before extracting the roll-holding cartridge 2 from the rolling mill, the hydraulic capsules 8, 9, 10, the balancing system and the spindles must be released from the respective working rolls 5, 6, 7. In particular, releasing means are provided for releasing the spindles from the working rolls, while the ends of the rods of the balancing systems are extracted from the respective grooves of the yoke supports so as not to hinder the lateral extraction movement of the cartridge.

The pair of rails 4, perpendicular to the rolling axis X, is provided within the rolling mill structure for each rolling stand, for the sliding of cartridge 2. To this end, cartridge 2 is provided with runners for sliding on rails 4; as an alternative to the runners, wheels may be used to roll on the rails. Actuation means, such as hydraulic cylinders (not shown), are provided underneath cartridge 2 which push cartridge 2 upwards in order to adjust the cartridge position for a correct insertion of the rod of the balancing system of the working roll 6, in a horizontal position, into the groove of the respective yoke support 12.

Advantageously, the rolling stand object of the present invention includes a locking device 20 for locking the position of the chocks within cartridge 2, in order to lock the chocks in a predetermined position before performing a lateral extraction of the cartridge from the rolling stand.

Such a locking device 20 includes a single actuator 14 and three stopping pins 15, 16, 17 and is configured so that actuator 14 actuates the three stopping pins together, so that each of the stopping pins 15, 16, 17 locks a respective yoke-chock group, acting directly on the chock, or on the yoke support, in a predetermined position which allows the "out of interference" stroke for cartridge change to be overlapped to the emergency stroke needed to remove the stuck.

The locking device therefore simultaneously acts on the three chocks which, in order to be engaged by the stopping pins, must be arranged, by means of the hydraulic capsules and the relative balancing systems, coaxial to the capsules themselves. Due to the non-reversibility of the movement, the locking device allows cartridge 2 to be carried by means of an overhead crane without having to mount or remove manual stops, and it also allows the cartridge rotation on the cartridge-turning machine without risk of sudden movements or downfalls of the chocks during the rotation of the cartridge itself.

In an advantageous embodiment of the invention, the actuator 14 is a rotating actuator, either hydraulic or electrical, connected to motion return means adapted to transform the rotation motion of the rotating actuator about a first axis Y into a rotation motion of each one of the stopping pins 15, 16, 17 about an axis Y', Y" thereof.

Advantageously, the rotating actuator 14 and the motion return means are mounted on the fixed bearing structure 3 of the rolling stand and not on the cartridge 2. This is intended to avoid having to connect and disconnect power sources to the cartridge itself.

On the other hand, the three stopping pins 15, 16, 17 are integral to cartridge 2 but can rotate about their own axis.

Figure 6:
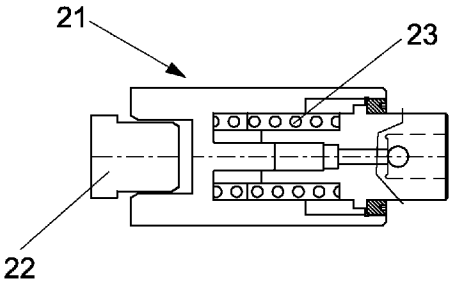
FIG. 6 shows a top sectional view of a detail of the rolling stand according to the invention.
Figure 4:
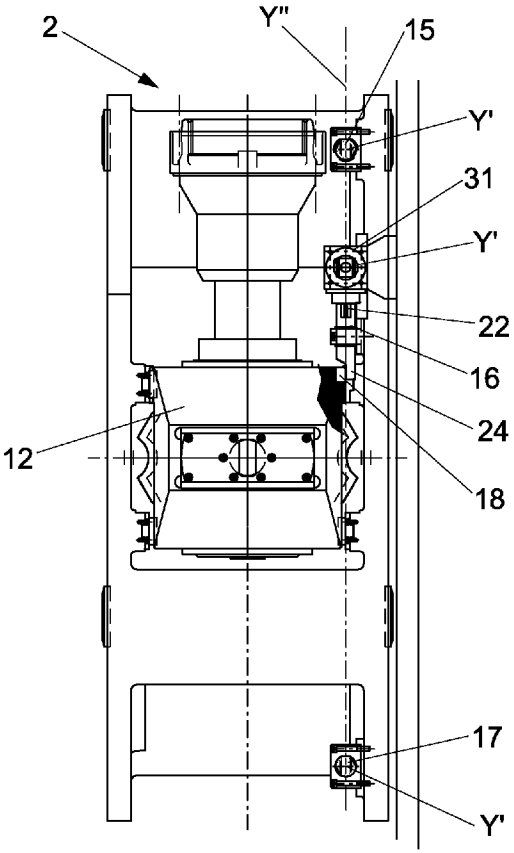
FIG. 4 shows a partial lateral view of the part of stand in FIG. 3.

The junction between the actuator 14 and the motion return means with the stopping pins 15, 16, 17 is obtained using three spring clutches 21, e.g. of the knife type, which are either directly or indirectly connected to first ends 22 (FIG. 6) of the stopping pins during the insertion movement of cartridge 2 in the rolling stand. The presence of springs 23 in clutches 21 serves to avoid damaging the clutch itself if the two half-couplings are facing not aligned with each other. Sensors may be provided for ensuring the safety of the clutch.

The stopping pins 15, 16, 17 can rotate about their axis between a free chock position and a constrained chock position.

In a preferred variant the stopping pins, cylindrical in shape, have second ends 24 opposite to the first ends 22, which are blunt so as to substantially have a semi-cylindrical shape; the chocks, in turn, are provided with a recess 18, obtained thereon, having a shape complementary to the shape of said second ends 24 of the stopping pins. In this way, by providing for the transmission of the stopping pins by a rotation of about 180°, the configuration is switched from free chock to constrained chock, and vice versa. Alternatively, recess 18, having a shape complementary to the shape of said second ends 24 of the stopping pins, may be obtained on each yoke support.

The vertical knife configuration of clutches 21 allows the lifting of cartridge 2 to the working position, without the risk of damaging the clutches themselves.

In particular a preferred variant, better shown in FIG. 3, provides for the rotation motion of the rotating actuator 14 about the first axis Y to be transformed, by means of the first return means 30, to a rotational motion of the clutches 21 about a respective second axis Y, perpendicular to the first axis Y.

The stopping pins 15 and 17, which cooperate with the chocks of the working rolls 5 and 7 having the rotation axis inclined by +/−30° with respect to a horizontal plane, define a longitudinal axis thereof coincident with the respective seconds axes Y. In this case, the first ends 22 of the stopping pins 15, 17 are directly connected to the respective clutches 21.

On the other hand, the stopping pin 16, which cooperates with the chock of the working roll 6 having its rotation axis vertical, defines its own longitudinal axis Y" perpendicular to the second axes Y, i.e. the stopping pin 16 is arranged orthogonally with respect to the other two stopping pins 15, 17 parallel to each other. Therefore, second return means 31 are provided for the stopping pin 16, which transform the rotation motion of the respective clutch 21 about the second axis Y' in a rotation motion of the stopping pin 16 about its axis Y". In this case, the first end 22 of the stopping pin 16 is connected to said second return means 31 which are integral to cartridge 2.

The invention claimed is:

1. A rolling stand with three working rolls for rolling seamless tubes with mandrel, the rolling stand defining a rolling axis and comprising a bearing structure, three working rolls each having a respective median plane lying on the rolling axis, wherein the median planes form an angle of 120° with each other, each of said three working rolls having a respective chock, a roll-holding cartridge wherein said three working rolls and said chocks are accommodated, a locking device for locking the position of said chocks within the roll-holding cartridge, in order to lock the chocks in a respective first radial position which allows an extraction of the roll-holding cartridge from the bearing structure and an insertion of the roll-holding cartridge in the bearing structure in a direction transversal to the rolling axis, wherein said locking device comprises three stopping pins, fastened to the roll-holding cartridge, and control means connected to the three stopping pins by means of a kinematic mechanism which allows a combined actuation of the three stopping pins so that each of the three stopping pins locks a respective chock in said respective first position.

2. A stand according to claim 1, wherein the control means comprise a single actuator, fastened to the bearing structure and connected by a quick coupling and release device to the three stopping pins.

3. A rolling stand according to claim 2, wherein said actuator is a rotating actuator connected to motion return means adapted to transform the rotation motion of the rotating actuator about a first axis into a rotation motion of each one of the stopping pins about an axis thereof.

4. A rolling stand according to claim 3, wherein a first and a second stopping pin are parallel to each other and define a respective second axis, perpendicular to said first axis, whereas a third stopping pin defines a third axis parallel to said first axis.

5. A rolling stand according to claim 4, wherein first return means are provided for each stopping pin to transform the rotation motion about the first axis into a rotation motion about respective second axes; and wherein second return means are provided only for the third stopping pin to transform the rotation motion about the respective second axis into a rotation motion about said third axis.

6. A rolling stand according to claim 1, wherein the chocks are provided with a recess, obtained thereon, and the stopping pins have an end with a shape complementary to the shape of said recess.

7. A rolling stand according to claim 1, wherein yoke supports, whereon a respective working roll with relevant chocks is mounted, are provided with a recess, obtained thereon, and the stopping pins have an end with a shape complementary to the shape of said recess.

8. A rolling stand according to claim 6, wherein the recess shape is semi-cylindrical.

9. A rolling stand according to claim 7, wherein the recess shape is semi-cylindrical.

* * * * *